US010337482B2

(12) United States Patent
Fujita et al.

(10) Patent No.: US 10,337,482 B2
(45) Date of Patent: Jul. 2, 2019

(54) STARTER

(71) Applicant: DENSO CORPORATION, Kariya, Aichi-pref. (JP)

(72) Inventors: Tatsuya Fujita, Kariya (JP); Takashi Hirabayashi, Kariya (JP); Tasuku Yamada, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/815,067

(22) Filed: Nov. 16, 2017

(65) Prior Publication Data

US 2018/0135584 A1 May 17, 2018

(30) Foreign Application Priority Data

Nov. 16, 2016 (JP) ..... 2016-223526

(51) Int. Cl.

| | |
|---|---|
| ***F02N 11/02*** | (2006.01) |
| ***F02N 11/08*** | (2006.01) |
| ***F02N 15/06*** | (2006.01) |
| ***F02N 15/02*** | (2006.01) |

(52) U.S. Cl.

CPC ..... *F02N 11/0855* (2013.01); *F02N 11/02* (2013.01); *F02N 11/087* (2013.01); *F02N 11/0851* (2013.01); *F02N 15/023* (2013.01); *F02N 15/063* (2013.01); *F02N 15/065* (2013.01); *F02N 15/067* (2013.01); *F02N 11/0844* (2013.01); *F02N 11/0859* (2013.01); *F02N 2011/0892* (2013.01)

(58) Field of Classification Search

CPC .... F02N 11/0855; F02N 11/087; F02N 11/02; F02N 11/0851; F02N 15/063; F02N 15/062; F02N 15/065; F02N 15/067; F02N 15/023

USPC ..... 123/179.25

See application file for complete search history.

(56) References Cited

U.S. PATENT DOCUMENTS 4,524,629 A * 6/1985 Digby ..... F02N 15/065 74/7 R
4,744,258 A * 5/1988 Volino ..... F02N 15/065 192/42

(Continued)

FOREIGN PATENT DOCUMENTS

JP H04-060172 A 2/1992
JP 2006-161590 A 6/2006

(Continued)

*Primary Examiner* — Mahmoud Gimie
(74) *Attorney, Agent, or Firm* — Oliff PLC

(57) ABSTRACT

A starter includes a coil spring disposed between a pinion gear and a motor and a buffer rubber disposed between the pinion gear and the coil spring. When the pinion gear is subjected to a reactive force from an engine, the buffer rubber absorbs the impact. Before the impact acts on the pinion gear, the coil spring is subjected to a given initial load. When the impact acts on the pinion gear, the coil spring absorbs it transmitted through the buffer rubber. The cover in which the coil spring is stored has a flange which is held from moving to the pinion gear in response to expansion of the coil spring, while it is permitted to move to the motor in response to contraction of the coil spring. This eliminates a risk that mechanical noise occurs when the pinion gear is advanced and then brought into mesh with the engine.

8 Claims, 9 Drawing Sheets

(56) References Cited

U.S. PATENT DOCUMENTS

| | | | | |
|---|---|---|---|---|
| 4,843,897 | A * | 7/1989 | Tallis, Jr. | F02N 15/026 74/6 |
| 4,912,991 | A * | 4/1990 | Giometti | F02N 15/063 192/103 A |
| 5,050,441 | A * | 9/1991 | Giometti | F02N 15/026 192/104 R |
| 5,237,882 | A * | 8/1993 | Giometti | F02N 15/063 192/103 A |
| 5,513,540 | A * | 5/1996 | Giometti | F02N 15/063 74/6 |
| 2010/0257975 | A1 | 10/2010 | Niimi et al. | |
| 2013/0291680 | A1 | 11/2013 | Odahara et al. | |
| 2015/0260144 | A1* | 9/2015 | Sasaki | F02N 15/023 74/7 C |

FOREIGN PATENT DOCUMENTS

| | | | |
|---|---|---|---|
| JP | 2012-122358 | A | 6/2012 |
| JP | 2013-057325 | A | 3/2013 |
| JP | 2014-177945 | A | 9/2014 |

* cited by examiner

STARTER

CROSS REFERENCE TO RELATED DOCUMENT

The present application claims the benefit of priority of Japanese Patent Application No. 2016-223526 filed on Nov. 16, 2016, the disclosure of which is incorporated herein by reference.

BACKGROUND

1 Technical Field

This disclosure relates generally to a starter working to start an internal combustion engine.

2 Background Art

Some starters for internal combustion engines are engineered to advance a pinion gear using a pusher to bring the pinion gear into engagement with a ring gear mounted on the engine and rotate the pinion gear using torque produced by an electrical motor to start the engine. Japanese Patent First Publication No. 2010-248920 teaches such a type of starter.

The above type of starter has a risk that the pinion gear is moved forward, but a tooth of the pinion gear fails to achieve engagement between teeth of the ring gear, in other words, after colliding with a side surface of the ring gear, the tooth of the pinion gear continues to be pushed against the side surface of the ring gear while being rotated and then achieves success in engagement between the teeth of the erring gear. The collision of the pinion gear with the ring gear will generate mechanical noise. In order to alleviate such noise, starters have been proposed which has a buffer, such as rubber, which is disposed between the pinion gear and the electric motor to absorb impact power or reactive force generated upon the collision of the pinion gear with the ring gear, thereby reducing the collision noise.

Japanese Patent First Publication No. 2006-161590 teaches a starter designed to have an elastic member, such as a spring, which is disposed between a pinion gear and an electric motor to assist in shifting the pinion gear to a ring gear mounted on an engine when the pinion gear has failed to engage the ring gear.

Pinion shift starters work to shift the pinion gear in an axial direction thereof about which the pinion gear rotates to achieve mesh with the ring gear. Usually, an end face of the pinion gear collides with that of the ring gear, after which the pinion gear is rotated to complete the mesh between the pinion gear and the ring gear. In order to ensure the stability in mesh between the pinion gear and the ring gear upon the collision thereof, use of an elastic member, like in the above latter publication, which is disposed on a rear end of the pinion gear has been proposed. When the end faces of the pinion gear and the ring gear collide with each other, the elastic member continues to push the pinion gear against the ring gear until completion of mesh between the pinion gear and the ring gear, thereby minimizing rebound of the pinion gear upon the collision to achieve success in engagement between the pinion gear and the ring gear. The elastic member is, thus, required to produce elastic pressure which advances or urges the pinion gear in an axial direction thereof until the completion of mesh of the pinion gear with the ring gear after the pinion gear collides with the ring gear. For instance, an initial load may be applied to the elastic member to produce a large elastic pressure and also achieve a long stroke of the elastic member. This, however, requires a degree of force which is greater than the initial load to compress the elastic member, thus resulting in a risk that mechanical noise occurs upon collision of the pinion gear with the ring gear.

A buffer, like in the starter taught in the above former publication, may, therefore, be used in addition to the elastic member to assist in shifting the pinion gear. The arrangement of the elastic member and the buffer, however, encounters the following drawbacks. The elastic member is, as described above, subjected to the initial load, so that an initial elastic pressure, as produced by the elastic member resulting from the application of the initial load thereto, acts on the buffer arranged adjacent the elastic member. This may cause the buffer to be undesirably compressed by the initial elastic pressure produced by the elastic member before the buffer undergoes reactive force from the ring gear, which may lead to a failure in operation of the buffer and generation of mechanical noise.

SUMMARY

It is therefore an object to provide a starter which is capable of reducing mechanical noise produced when a pinion gear is advanced.

According to one aspect of the invention, there is provided a starter which comprises: (a) a motor which has a rotation shaft; (b) a pinion gar which is movable in an axial direction of the rotation shaft of the motor; (c) a shifter which works to shift the pinion gear in the axial direction of the rotation shaft toward a front end of the rotation shaft for bringing the pinion gear into engagement with a ring gear of an internal combustion engine for rotating the pinion gear using the motor to start the internal combustion engine; (d) a first elastic member which is disposed between the pinion gear and the motor and configured to be contracted to permit the pinion gear to move to the motor along the rotation shaft; (e) a second elastic member which is disposed between the pinion gear and the first elastic member; (f) a holder which retains therein the first elastic member while being subjected to a given initial load and is movable in the axial direction of the rotation shaft in response to expansion or contraction of the first elastic member; and (g) a contacting portion which is formed by a portion of the holder and placed in contact with the second elastic member in the axial direction of the rotation shaft, the contacting portion being held from being moved to the pinion gear in response to expansion of the first elastic member, while being permitted to be moved to the motor in response to contraction of the first elastic member.

The starter is designed to have the first elastic member and the second elastic member arranged between the pinion gear and the motor. When the pinion gear is subjected to the reactive force from the ring gear, the first elastic member and the second elastic member work to absorb the reactive force. The first elastic member is contracted in response to the reactive force, thereby permitting the pinion gear to slide on the rotating shaft to the motor.

The holder retains the first elastic member therein while exerting a given initial load to the first elastic member is equipped with the contacting portion placed in contact with the second elastic member in the axial direction of the rotation shaft. The contacting portion is held from moving to the pinion gear in response to expansion of the first elastic member, but permitted to move to the motor in response to compression of the first elastic member. Specifically, the contacting portion is stopped from moving to the pinion gear in response to the expansion of the first elastic member, thereby reducing an undesirable amount of contraction of the second elastic member between the pinion gear and the first elastic member which arises from application of elastic force from the first elastic member. Consequently, an allowable amount by which the second elastic member is permitted to be compressed at an initial stage where the reactive force is exerted by the ring gear on the pinion gear is ensured, thereby assuring the stability of an impact-absorbing operation of the second elastic member. The contacting portion is permitted to move to the motor following the contraction of the first elastic member, thereby absorbing the reactive force from the ring gear and permitting the pinion gear to be retracted.

The starter is, therefore, capable of minimizing mechanical noises arising from collisions between the ring gear and the pinion gear and between the pinion gear and the holder.

In the preferred mode of this disclosure, the holder includes a first pressure-exerted member on which an elastic force, as produced by the first elastic member, is exerted by a first end that is one of opposed ends of the first elastic member which is closer to the pinion gear and a second pressure-exerted member on which the elastic force, as produced by the first elastic member, is exerted by a second end that is one of the opposed ends of the first elastic member which is closer to the motor. The starter also includes a stopper which is placed in contact with the second pressure-exerted member and works to stop the second pressure-exerted member from being moved to the pinion gear from an initial location where the second pressure-exerted member is subjected to no reactive force from the ring gear, thereby holding the contacting portion from being moved to the pinion gear.

The stopper works to hold the second pressure-exerted member from being moved from the initial location where it undergoes no reactive force from the ring gear toward the pinion gear, thereby ensuring the stability in stopping the contacting portion from being shifted to the pinion gear.

In the second preferred mode, the first elastic member may be implemented by a coil spring wound around an outer periphery of the rotation shaft. The stopper may also be implemented by a protrusion formed on the outer periphery of the rotation shaft. The second pressure-exerted member is located on an opposite side of the protrusion to the first elastic member.

The above layout of the stopper protruding from the outer periphery of the rotation shaft and the second pressure-exerted member of the holder facilitates holding of the contacting portion from moving to the pinion gear.

In the third preferred mode, the second pressure-exerted member is movable away from the stopper in response to contraction of the first elastic member to permit the contacting portion to be moved to the motor.

Specifically, the contraction of the first elastic member due to the reactive force from the ring gear when the pinion gear has advanced to the ring gear will cause the second pressure-exerted member to be moved away from the stopper toward the motor. The contacting portion of the holder is, therefore, moved to the motor, thereby desirably absorbing the reactive force from the ring gear.

In the fourth preferred mode, the stopper is implemented by a protrusion formed on at least a portion of a circumference of the rotation shaft. The protrusion is located closer to the motor than the first elastic member is. The protrusion has side walls which are opposed to each other in a circumferential direction of the rotation shaft to define an air gap which enables the second pressure-exerted member to be arranged on the rotation shaft closer to the motor than the stopper is when the holder is mounted on the rotation shaft. The second pressure-exerted member is located closer to the motor than the stopper is and subjected to the elastic force, as produced by the first elastic member, through the stopper.

The above arrangements facilitate the ease with which the first pressure-exerted member and the second pressure-exerted member of the holder are fabricated in the starter without need for press work on the end of the holder.

In the fifth preferred mode, the holder may include a first pressure-exerted member on which an elastic force, as produced by the first elastic member, is exerted by a first end that is one of opposed ends of the first elastic member which is closer to the pinion gear and a second pressure-exerted member on which the elastic force, as produced by the first elastic member, is exerted by a second end that is one of the opposed ends of the first elastic member which is closer to the motor. The starter also includes a protrusion which is formed on at least a portion of a circumference of the rotation shaft and located closer to the motor than the first elastic member is. The second pressure-exerted member is movable closer to the motor than the protrusion on the rotation shaft. When the second pressure-exerted member is placed closer to the motor than the protrusion, the second pressure-exerted member is subjected to the elastic force, as produced by the first elastic member, through the protrusion.

Specifically, the contraction of the first elastic member due to the reactive force from the ring gear when the pinion gear has advanced to the ring gear will cause the second pressure-exerted member to be moved away from the protrusion toward the motor on the rotation shaft. When the second pressure-exerted member has moved away from the protrusion toward the motor, the protrusion is subjected to the elastic pressure produced by the first elastic member, thereby absorbing the reactive force from the ring gear.

In the sixth preferred mode, the second elastic member is implemented by a shock absorber which is deformed between the pinion gear and the contacting portion in response to the reactive force from the ring gear to absorb impact exerted on the pinion gear. A void which the second elastic member partially enters when deformed is formed between the pinion gear and the contacting portion. This avoids direct contact between the pinion gear and the contacting portion, thereby eliminating a risk that mechanical noise occurs which arises from impact of the pinion gear on the contacting portion.

In the seventh preferred mode, the second elastic member is implemented by a shock absorber which is deformed between the pinion gear and the contacting portion by reactive force from the ring gear to absorb impact exerted on the pinion gear. The starter also includes a stopper which is disposed between the pinion gear and the contacting portion and serves to stop the second elastic member from being deformed to more than a given extent in response to reactive force from the ring gear. In other words, the stopper prevents the second elastic member from being permanently deformed without returning to its original shape.

In the eighth preferred mode, an initial elastic force produced by the second elastic member is set smaller than that produced by the first elastic member. Accordingly, when a degree of the reactive force which is smaller than that of the initial elastic force produced by the first elastic member is exerted on the pinion gear, it will cause the second elastic member to be compressed, thereby absorbing the reactive force. It is also possible to reduce the size of the second elastic member.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 5(*b*) is a partially sectional view which illustrates the inner tube and the cover in FIG. 5(*a*);

DESCRIPTION OF THE PREFERRED EMBODIMENTS

Figure 1:
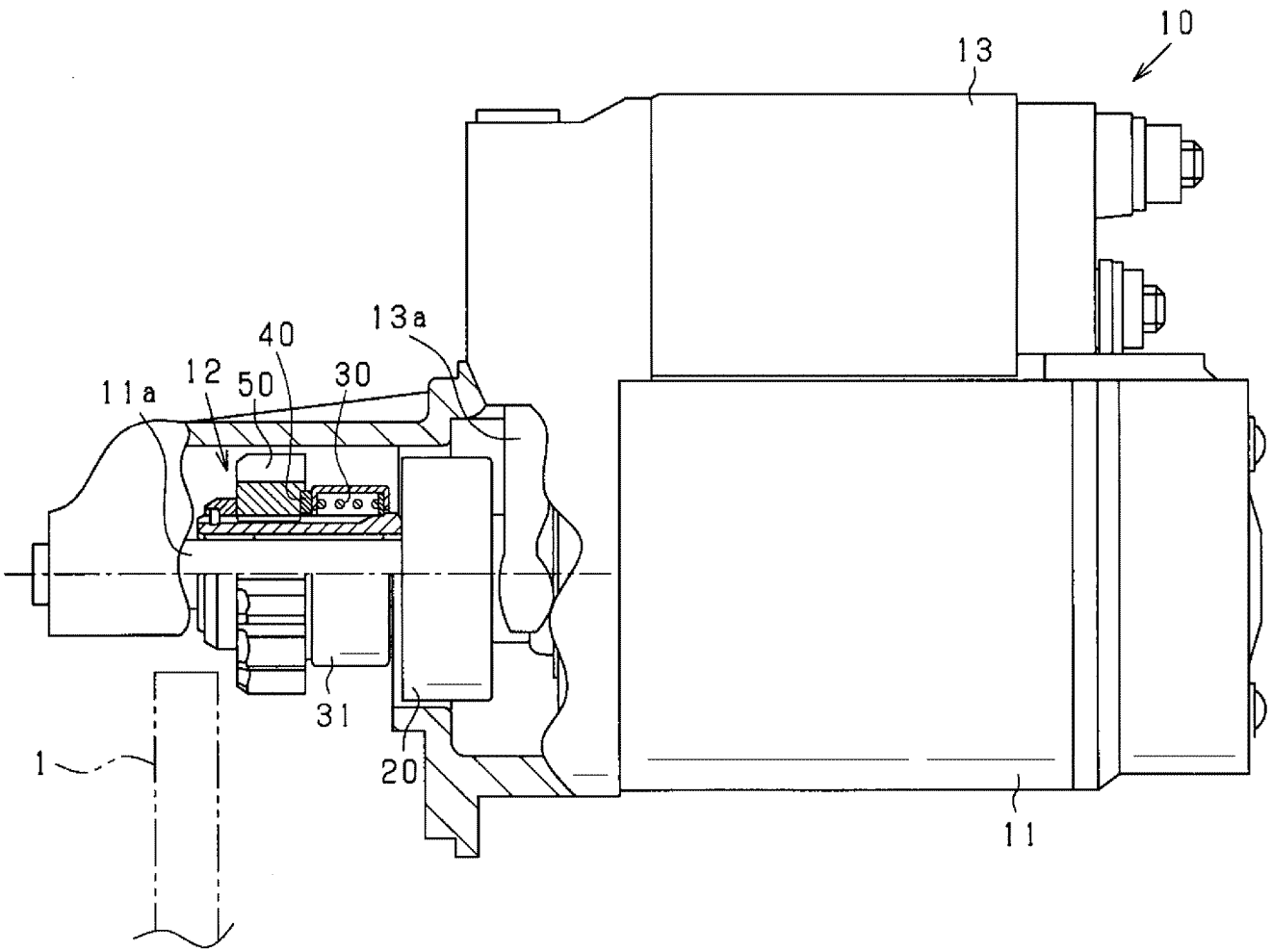
FIG. 1 is a partially sectional side view which illustrates a starter according to an embodiment.

Referring to the drawings, particularly to FIG. 1, there is shown the starter 10 according to an embodiment. Throughout several views, the same reference numbers refer to the same or similar parts, and explanation thereof in detail will be omitted.

The starter 10 illustrated in FIG. 1 is installed in a vehicle, such as an automobile, and works as an engine starting device to start an engine, such as an internal combustion engine, mounted in the vehicle. The starter 10 includes the electrical motor 11 equipped with the output shaft (i.e., a rotation shaft) 11*a*, the pinion carrier 12 which is movable in an axial direction of the output shaft 11*a*, and the pinion shifter 13*a* which advances or shifts the pinion carrier 12 in the axial direction away from the motor 11 (i.e., a leftward direction in FIG. 1) to bring the pinion gear 50 into engagement with the ring gear 1 mounted on, for example, a crankshaft of the engine. FIG. 1 is a partial sectional view for illustrating the pinion carrier 12.

When supplied with electric power, the motor 11 starts to rotate the output shaft 11*a*, thereby rotating the pinion gear 50 for cranking the engine. The electric power is delivered to the motor 11 when a starter switch, not shown, is closed.

Figure 2:
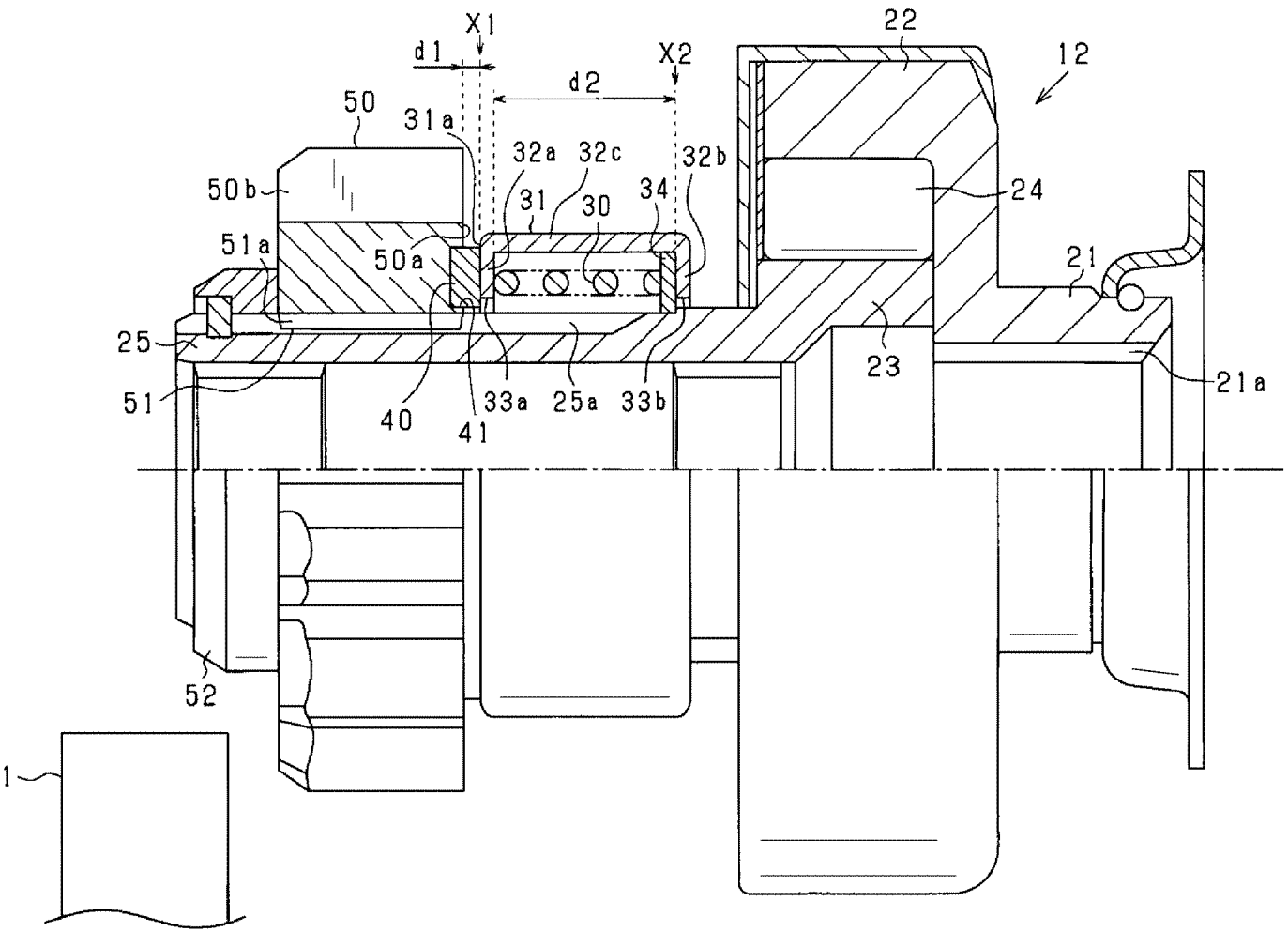
FIG. 2 is a partially longitudinal sectional view which illustrates a pinion shifter mounted in the starter of FIG. 1.

The pinion carrier 12, as illustrated in FIG. 2, includes the overrunning clutch 20, the coil spring 30, the buffer rubber 40, and the pinion gear 50. The overrunning clutch 20 is mounted on the output shaft 11*a* of the motor 11. The coil spring 30 works as a first elastic member and is disposed farther away from the motor 11 than the clutch 20 is in the axial direction of the output shaft 11*a*. The buffer rubber 40 works as a second elastic member and is disposed farther away from the motor 11 than the coil spring 30 in the axial direction of the output shaft 11*a*. The pinion gear 50 is located farther away from the motor 11 than the buffer rubber 40 is in the axial direction of the output shaft 11*a*.

The clutch 20 includes the spline tube 21, the outer 22 (i.e., an outer race), the inner 23 (i.e., an inner race), the clutch rollers 24, and the inner tube 25. The spline tube 21 is mounted on the output shaft 11*a*. The outer 22 is formed integrally with the spline tube 21. The inner 23 is rotatable inside the outer 22. The clutch rollers 24 work to establish or block transmission of torque between the outer 22 and the inner 23. The inner tube 25 is formed integrally with the inner 23. The inner tube 25 serves as a rotation shaft of the motor 11, in other words, a rotation shaft driven by torque produced by the motor 11 to rotate the pinion gear 50.

The spline tube 21 has helical splines 21*a* formed in an inner periphery thereof. The helical splines 21*a* engage helical splines formed in an outer periphery of the output shaft 11*a*. When the output shaft 11*a* of the motor 11 rotates, it will cause the outer 22 to rotate together with the output shaft 11*a* and the clutch 20 to be moved away from the motor 11 (i.e., the leftward direction in FIG. 2) by a given distance in the axial direction of the output shaft 11*a*.

When rotated following the rotation of the spline tube 21, the outer 22 transmits torque to the inner 23 through the clutch rollers 24, while the outer 22 blocks transmission of torque from the inner 23. The clutch 20, thus, functions as a one-way clutch to permit the torque to be transmitted only from the outer 22 to the inner 23.

The inner tube 25 is of a hollow cylindrical shape and extends from the inner 23 away from the motor 11 (i.e., the leftward direction in FIG. 2) in the axial direction of the output shaft 11*a*. The inner tube 25 is mounted on the outer periphery of the output shaft 11*a* through a bearing to be rotatable relative to the output shaft 11*a*. The inner tube 25 is formed integrally with the inner 23, so that it rotates together with the inner 23. In other words, the inner tube 25 serves as an axis of rotation of the inner 23. The inner tube 25 has straight splines 25 extending in an axial direction thereof.

The coil spring 30 is arranged on the inner tube 25. The coil spring 30 is disposed between the pinion gear 50 and the motor 11. When compressed, the coil spring 30 permits the pinion gear 50 to be moved toward the motor 11 along the inner tube 25. The coil spring 30 is implemented by a spiral spring and made of metal. The coil spring 30 has an inner diameter greater than an outer diameter of the inner tube 25, so that the inner tube 25 passes through the coil spring 30. In other words, the coil spring 30 is wound around the outer periphery of the inner tube 25 which, as described above, serves as the rotation shaft of the motor 11. When the coil spring 30 is compressed in the axial direction thereof, it generates elastic pressure in the axial direction.

The elastic constant of the coil spring 30 and the distance by which the coil spring 30 is contractable in the axial direction thereof are selected to make the coil spring 30 work as an absorber to absorb reactive force acting on the pinion gear 50 for facilitating shifting of the pinion gear 50 away from the motor 11. The elastic constant is a proportional constant derived by dividing a load to which an elastic member is subjected by an amount by which the elastic member expands or contracts and also called a spring constant. The elastic constant usually depends upon, for example, the diameter of wire of a spring or the outer diameter of a coil spring.

The inner tube 25 has disposed on an outer periphery thereof the stopper 34 designed in the shape of a protrusion extending outwardly in the radial direction of the inner tube 25. The stopper 34 is placed in contact with one of ends of the coil spring 30 which are opposed to each other in the axial direction of the coil spring 30. Specifically, the stopper 34 is placed in contact with the end of the coil spring 30 which is located closer to the motor 11. The stopper 34 is formed in the shape of a protrusion on the outer periphery of the inner tube 25. Specifically, the stopper 34 is made of an annular metallic plate. The stopper 34 is firmly secured to the outer peripheral surface of the inner tube 25. Specifically, the stopper 34 is located closer to the motor 11 than the straight splines 25*a* of the inner tube 25 are in the axial direction of the inner tube 25. The attachment of the stopper 34 to the inner tube 25 is achieved by slipping the stopper 24 on the outer periphery of the inner tube 25 from the front end thereof and press-fitting it on the inner tube 25 at a given location. The stopper 34 may alternatively be attached to the inner tube 25 using adhesive or a screw.

The stopper 34 has an outer circumference located outside the coil spring 30 in the radial direction of the coil spring 30. In other words, the outer diameter of the stopper 34 is greater than the inner diameter of the coil spring 30. The coil spring 30 is located on a portion of the inner tube 25 which is closer to the pinion gear 50 than the stopper 34 is. The end of the coil spring 30 which faces the motor 11 is, thus, placed in contact with the stopper 34. This stops to the coil spring 30 from moving toward the motor 11 across the stopper 34. Therefore, when force is exerted on the coil spring 30 from the pinion gear 50 in the axial direction of the coil spring 30, it will cause the end of the coil spring 30 which is closer to the motor 11 to be pressed against the stopper 34, so that it is contracted.

The inner tube 25 has mounted thereon the cover 31 which retains the coil spring 30. The cover 31 is of a hollow cylindrical shape and made of metal such as SPCC (i.e., Steel Plate Cold Commercial) or SECC (i.e., Steel Electrolytic Cold Commercial). The cover 31 retains the coil spring 30 therein and holds it from expanding outward in the radial direction of the coil spring 30. Specifically, the cover 31 has the peripheral side wall 32*c* which covers the outer periphery of the coil spring 30 in the radial direction of the inner tube 25. The peripheral side wall 32*c* is shaped to have an inner diameter which is selected to allow the coil spring 30 to return to its original shape when the coil spring 30 is rotated together with the inner tube 25 and then has expanded outward until an outer circumference of the coil spring 30 contacts the inner circumference of the peripheral side wall 32*c*. For instance, the inner diameter of the peripheral side wall 32*c* is selected to be slightly greater than the outer diameter of the coil spring 30. This prevents the coil spring 30 from being permanently deformed without returning to its original shape when the coil spring 30 is pulled outwardly by the centrifugal force, thereby ensuring the stability of the coil spring 30 in generating elastic force.

The cover 31 is movable in the axial direction thereof depending upon expansion or contraction of the coil spring 30. Specifically, the cover 31 has flanges 32*a* and 32*b* which define ends of the cover 31 opposed to each other in the axial direction of the cover 31. The flange 32*a* is located closer to the pinion gear 50 than the flange 32*b* is and will also be referred to below as a pinion-side flange. The pinion-side flange 32*a* has formed in the center thereof the through hole 33*a* which has a diameter greater than the outer diameter of the inner tube 25. The flange 32*b* is located closer to the motor 11 than the flange 32*a* is and will also be referred to below as a motor-side flange. The motor-side flange 32*b* has formed in the center thereof the through hole 33*b* which has a diameter greater than the outer diameter of the inner tube 25. The cover 31 is fit on the outer periphery of the inner tube 25 with the inner tube 25 passing through the holes 33*a* and 33*b* so as to permit the cover 31 to move or slide on the inner tube 25 in the lengthwise direction of the inner tube 25.

Figure 3:
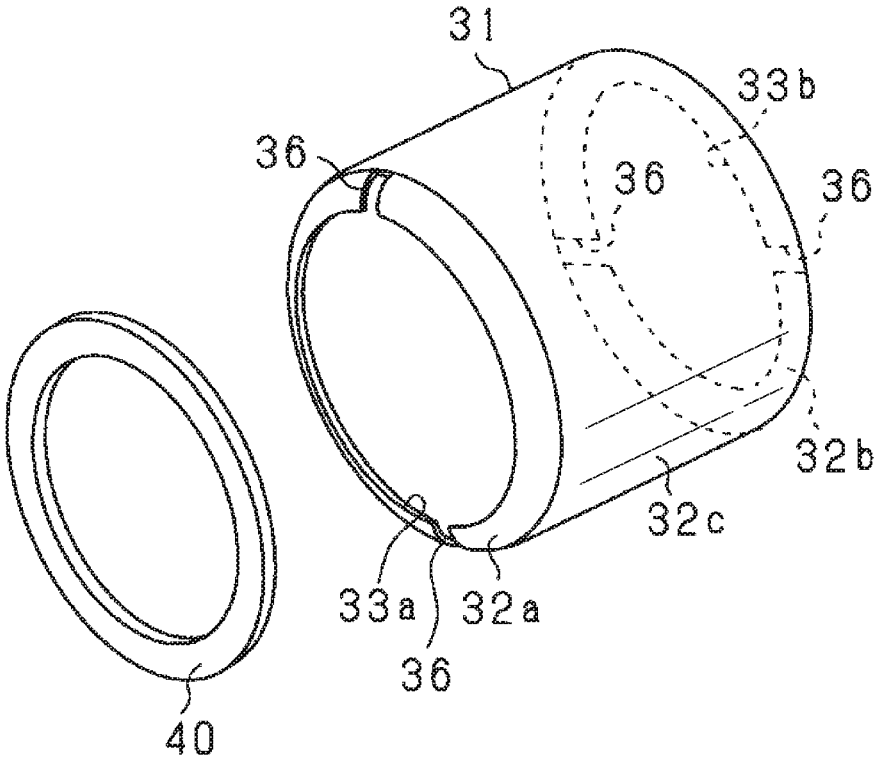
FIG. 3 is a perspective view which illustrates a cover and a buffer rubber mounted in the starter of FIG. 1.

Next, the buffer rubber 40 will be described below. The buffer rubber 40 is arranged between the pinion gear 50 and the coil spring 30. The buffer rubber 40 is, as clearly illustrated in FIG. 3, of an annular or ring-shape and works as a shock absorber made of synthetic resin (e.g., elastomer such as rubber). The buffer rubber 40 has an inner diameter greater than the outer diameter of the inner tube 25. The buffer rubber 40 is disposed around the inner tube 25 coaxially therewith. In other words, the buffer rubber 40 surrounds the outer circumference of the inner tube 25. This layout causes centrifugal force, as produced when the buffer rubber 40 rotates around the inner tube 25, to be exerted uniformly on the buffer rubber 40, thereby minimizing deformation of the buffer rubber 40.

The elastic force the buffer rubber 40 is capable of generating is set smaller than that the coil spring 30 is capable of generating. Specifically, the elastic constant of the buffer rubber 40 is set smaller than that of the coil spring 30. The natural dimension (i.e., the thickness) of the buffer rubber 40 is smaller than the natural length of the coil spring 30. Before the pinion gear 50 is advanced, the amount by which the buffer rubber 40 contracts, that is, is compressed is smaller than that by which the coil spring 30 is compressed. In other words, before the pinion gear 50 is subjected to reactive force from the ring gear 1 in the axial direction thereof (i.e., in an initial state), an initial elastic force, as produced by the coil spring 30, is greater than that produced by the buffer rubber 40.

Next, the pinion gear 50 will be described below in detail. The pinion gear 50 has formed therein the fitting hole 51 in which the outer periphery of the inner tube 25 is fit. The pinion gear 50 also has straight splines 51*a* formed in the inner periphery of the fitting hole 51. The straight splines 51*a* of the pinion gear 50 mesh with the straight splines 25*a* of the inner tube 25, so that the pinion gear 50 rotates together with the inner tube 25. This causes the pinion gear 50 to be rotated by output torque from the motor 11.

The pinion gear 50 is movable on the outer periphery of the inner tube 25 along the straight splines 51*a* (i.e., the output shaft 11*a*). The inner tube 25 has the stopper 52 fit on the front end thereof farther away from the motor 11 (i.e., the left end of the inner tube 25, as viewed in FIG. 2). The stopper 52 protrudes from the outer circumference of the inner tube 25 to hold the pinion gear 50 from falling out of the inner tube 25. The stopper 52 is greater in diameter than the fitting hole 51 to stop the pinion gear 50 from moving outside the inner tube 25 in the axial direction thereof.

The pinion gear 50 has the housing groove 41 which is formed in the end thereof which is closer to the motor 11 and in which the buffer rubber 40 is partially retained. When viewed in the axial direction of the output shaft 11*a*, the housing groove 41 is of an annular shape contoured to conform with the outline of the buffer rubber 40. The housing groove 41 is rectangular in traverse section thereof. When the buffer rubber 40 is fit in the housing groove 41, it partly protrudes from the end surface of the pinion gear 50 toward the motor 11. In other words, the depth of the housing groove 41 is shorter than the thickness of the buffer rubber 40 in the axial direction of the output shaft 11*a*.

The outer diameter of the housing groove 41 (i.e., the diameter of the outer circumference of the housing groove 41) is substantially equal to that of the buffer rubber 40. The buffer rubber 40 is, therefore, fit in the housing groove 41 without any play. Therefore, when the buffer rubber 40 rotates along with the pinion gear 50, so that centrifugal force acts on the buffer rubber 40, the inner wall of the housing groove 41 is kept engaged with the buffer rubber 40. This prevents the buffer rubber 40 from being plastically deformed to the degree to which the buffer rubber 40 will not return to its original shape after the buffer rubber 40 rotates together with the pinion gear 50. The buffer rubber 40 is made of elastically deformable synthetic resin, which facilitates fitting of the buffer rubber 40 in the housing groove 41 and resists shifting of the buffer rubber 40 when subjected to torque.

Referring back to FIG. 1, the pinion shifter 13*a* will be discussed below. The pinion shifter 13*a* is secured to the electromagnetic solenoid 13 and actuated by drive power produced by the electromagnetic solenoid 13. Specifically, when a starter switch, not shown, is closed, the pinion shifter 13*a* is operated by the drive power produced by the electromagnetic solenoid 13 to move the pinion carrier 12 toward the front end of the inner tube 25 (i.e., the left in FIG. 1) in the axial direction of the output shaft 11*a*. Alternatively, when the starter switch is opened, the pinion shifter 13*a* retracts the pinion carrier 12 toward the motor 11 (i.e., the right in FIG. 1) in the axial direction of the output shaft 11*a*.

The assembly of the thus constructed the coil spring 30 and the buffer rubber 40 work to absorb reactive force (i.e., mechanical impact) applied by the ring gear 1 to the pinion gear 50 when the pinion gear 50 collides with the ring gear 1. This will also be discussed below in detail.

Before the pinion gear 50 is subjected to reactive force from the ring gear 1 in the axial direction of thereof, that is, the pinion gear 50 is advanced, the coil spring 30 is retained by the cover 31 while being subjected to a given initial load. In other words, the cover 31 holds the coil spring 30 compressed in the axial direction thereof between the pinion gear 50 and the motor 11. Specifically, when the pinion gear 50 is placed in contact with the stopper 52, the distance between the pinion-side flange 32*a* of the cover 31 and the stopper 34 is set shorter than the natural length of the coil spring 30 in the cover 31. This makes the cover 31 function as a holder.

Before the pinion gear 50 is subjected to reactive force from the ring gear 1 in the axial direction of thereof, the buffer rubber 40 is retained by the inner tube 25 while being compressed in the axial direction thereof between the pinion gear 50 and the coil spring 30. In other words, when the pinion gear 50 is placed in contact with the stopper 52, the distance between the end of the pinion gear 50 and the cover 31 is set shorter than the natural thickness of the buffer rubber 40 in the axial direction of the output shaft 11*a*.

Therefore, before the pinion gear 50 undergoes the reactive force from the ring gear 1 in the axial direction thereof, the coil spring 30 and the buffer rubber 40 each produce the elastic force which presses the pinion gear 50 against the stopper 52. Similarly, the buffer rubber 40 is pressed against the pinion gear 50. The coil spring 30 is pressed against the buffer rubber 40 through the cover 31. This eliminates an air gap between the pinion gear 50 and the buffer rubber 40 and between the buffer rubber 40 and the coil spring 30. Accordingly, when the ring gear 1 and the pinion gear 50 collide with each other, so that the pinion gear 50 is moved relative to the inner tube 25 toward the motor 11, it will cause the buffer rubber 40 to be compressed by the movement of the pinion gear 50 to absorb the mechanical impact on the pinion gear 50.

Application of force or impact which is greater than the initial elastic force produced by the coil spring 30 from the buffer rubber 40 to the coil spring 30 will cause the buffer rubber 40 to be moved together with the pinion gear 50 relative to the inner tube 25 toward the motor 11. The movement of the pinion gear 50 and the buffer rubber 40 toward the motor 11 causes the coil spring 30 to be compressed to absorb the impact (i.e., the reactive force from the ring gear 1). When compressed, the coil spring 30 stores elastic force therein which works to shift the pinion 50 away from the motor 11 through the cover 31 and the buffer rubber 40. This assists in pressing the pinion gear 50 against the ring gear 1 if the pinion gear 50 has failed to be brought by the pinion shifter 13*a* into mesh with the ring gear 1.

Before the pinion gear 50 is advanced, the pinion gear 50 is placed in abutment with the stopper 52, and the cover 31 is also placed in abutment with the stopper 34. This eliminates mechanical noise arising from a collision between the pinion gear 50 and the stopper 52 or between the cover 31 and the stopper 34. The above layout also eliminates a risk of generation of mechanical noise caused by sliding movement of the pinion gear 50 and the cover 31 before the pinion gear 50 is advanced.

The coil spring 30 is, as described above, designed to have an elastic constant and a contractable length required to assist in pressing the pinion gear 50 against the ring gear 1 to achieve engagement therebetween. The initial load is applied to the coil spring 30 in order for the coil spring 30 to produce a large degree of elastic force when slightly compressed. The coil spring 30 is, however, not compressed unless a degree of force greater than an initial elastic force, as generated by the coil spring 30 subjected to the initial load, is exerted on the coil spring 30, which leads to a failure in absorbing the reactive force acting on the pinion gear 50. Direct collision of the pinion gear 50 with the cover 31 may generate impact noise. In order to eliminate such noise, the buffer rubber 40 is disposed between the pinion gear 50 and the coil spring 30 and works as an absorber to absorb the impact.

The initial elastic force produced by the buffer rubber 40 is, therefore, set lower than that generated by the coil spring 30. This causes the buffer rubber 40 to be compressed before the reactive force which is greater than the initial elastic force produced by the coil spring 30 is transmitted to the coil spring 30, thereby absorbing the reactive force. This also enables the buffer rubber 40 to be reduced in size than the coil spring 30, which also permits the pinion gear 50 to be reduced in size and weight. It is, therefore, possible to downsize the housing groove 41 formed in the pinion gear 50 as compared with a case where the coil spring 30 is mounted in the housing groove 41, which enables the pinion gear 50 to be reduced in weight thereof. The reduced weight of the pinion gear 50 usually results in a decrease in impact noise arising from a collision between the pinion gear 50 and the ring gear 1 regardless of speed at which the pinion gear 50 collides with the ring gear 1.

Before the pinion gear 50 is subjected to the reactive force from the ring gear 1, the coil spring 30 is set greater in initial elastic force than the buffer rubber 40, thereby enabling the coil spring 30 to be slightly compressed to produce elastic force great enough to press the pinion gear 50 against the ring gear 1 if the pinion shifter 13*a* has failed to bring the pinion gear 50 into mesh with the ring gear 1 to assist in achieving engagement between the pinion gear 50 and the ring gear 1.

Conversely, the buffer rubber 40 is lower in initial elastic force than the coil spring 30, thus resulting in a risk that when the buffer rubber 40 is placed in direct contact with the coil spring 30 before the pinion gear 50 is advanced, it will cause the buffer rubber 40 to be excessively compressed due to the difference in elastic force between the buffer rubber 40 and the coil spring 30. This may result in a lack of contraction of the buffer rubber 40 when subjected to the reactive force from the ring gear when the pinion gear 50 is advanced, which will lead to a lack of the shock-absorbing operation of the buffer rubber 40. This may result in impact noise between the pinion gear 50 and the ring gear 1 and between the pinion gear 50 and the cover 31. The lack of the shock-absorbing operation of the buffer rubber 40 requires improvement of durability of the pinion gear 50 and the cover 31 against the impact acting thereon. In order to prevent the buffer rubber 40 from being undesirably compressed before the pinion gear 50 is advanced, the starter 10 is designed to have the following structure.

The pinion-side flange 32*a* of the cover 31 is, as described above, placed in abutment with the buffer rubber 40 in the axial direction of the output shaft 11*a*. The pinion-side flange 32*a*, therefore, serves as a contacting portion which is placed in contact with the buffer rubber 40 and held by the buffer rubber 40 from being moved by expansion of the coil spring 30 toward the pinion gear 50, while it is permitted to be moved toward the motor 11 upon contraction of the coil spring 30.

Specifically, the pinion-side flange 32*a* of the cover 31 is subjected to elastic force from the end of the coil spring 30 which is closer to the pinion gear 50. In other words, the pinion-side flange 32*a* is placed in abutment with the end of the coil spring 30 closer to the pinion gear 50. More specifically, the diameter of the through hole 33*a* in the pinion-side flange 32*a* is smaller than the outer diameter of the coil spring 30. The pinion-side flange 32*a* extends from inside to outside the coil spring 30 in the radial direction thereof. The pinion-side flange 32*a* serves as a first pressure-exerted member on which the elastic force, as produced by the coil spring 30, exerted by the end (which will also be referred to as a first end) of the coil spring 30 closer to the pinion gear 50.

The pinion-side flange 32*a* is, therefore, placed in abutment with the end of the coil spring 30 closer to the pinion gear 50 within the cover 31. The pinion-side flange 32*a* of the cover 31 serves as a stopper to stop the coil spring 30 from moving outside the cover 31 in the axial direction of the output shaft 11*a*, that is, moving outside the pinion-side flange 32*a* toward the pinion gear 50 in the axial direction of the coil spring 30.

The motor-side flange 32*b* of the cover 31 is subjected to elastic force from the end of the coil spring 30 which is closer to the motor 11. In other words, the motor-side flange 32*b* is placed in abutment with the end of the coil spring 30 closer to the motor 11. More specifically, the diameter of the through hole 33*b* in the motor-side flange 32*b* is smaller than the outer diameter of the coil spring 30. The motor-side flange 32*b* extends from inside to outside the coil spring 30 in the radial direction thereof. The motor-side flange 32*b* serves as a second pressure-exerted member on which the elastic force, as produced by the coil spring 30, exerted by the end (which will also be referred to as a second end) of the coil spring 30 closer to the motor 11.

The motor-side flange 32*b* of the cover 31 is also placed in abutment with the stopper 34. Specifically, the diameter of the through hole 33*b* of the motor-side flange 32*b* is smaller than the outer diameter of the stopper 34, so that the motor-side flange 32*b* is placed in direct contact with the stopper 34.

The stopper 34 is arranged inside the cover 31. Specifically, the diameter of the stopper 34 is smaller than the inner diameter of the cover 31 (i.e., the peripheral side wall 32*c*). The stopper 34 is disposed between the pinion-side flange 32*a* and the motor-side flange 32*b*. The stopper 34 works to hold the motor-side flange 32*b* from moving toward the pinion gear 50 from an initial location X2 where the motor-side flange 32*b* receives no reactive force from the ring gear 1. The motor-side flange 32*b* is placed in direct contact with the stopper 34 and thus stopped from moving to the pinion gear 50 cover the stopper 34. The initial location X2 of the motor-side flange 32*b* is a location where the motor-side flange 32*b* is in contact with the stopper 34.

The interval d2 between the pinion-side flange 32*a* and the motor-side flange 32*b* in the axial direction of the output shaft 11*a* is constant. The pinion-side flange 32*a* and the motor-side flange 32*b* are mechanically joined together through the peripheral side wall 32*c* of the cover 31. In other words, the length of the peripheral side wall 32*c* in the axial direction of the output shaft 11*a* is identical with the interval d2.

The coil spring 30 is disposed within the cover 31 and located closer to the pinion gear 50 than the stopper 34 is in the axial direction of the output shaft 11*a*. In other words, the motor-side flange 32*b* of the cover 31 is located on an opposite side of the stopper 34 to the coil spring 30. The coil spring 30 is disposed in the cover 31 while being compressed. In other words, the distance between the pinion-side flange 32*a* and the stopper 34 is shorter than the natural length of the coil spring 30 when being uncompressed. The distance between the pinion-side flange 32*a* and the stopper 34 is selected so that when the stopper 34 is placed in contact with the motor-side flange 32*b*, a given degree of initial load is applied to the coil spring 30.

With the above arrangements, the cover 31 is movable in the axial direction of the inner tube 25 with contraction or expansion of the coil spring 30. When urged toward the motor 11, the cover 11 will be moved to the motor 11 while compressing the coil spring 30. Alternatively, the expansion of the coil spring 30 will cause the pinion-side flange 32*a* of the cover 31 to urge the cover 11 to the pinion gear 50.

The stopper 34, as described above, stops the motor-side flange 32*b* from moving toward the pinion gear 50, thereby holding the pinion-side flange 32*a* which is joined to the motor-side flange 32*b* from moving to the pinion gear 50. In other words, the contact of the motor-side flange 32*b* with the stopper 34 will hold the pinion-side flange 32*a* from moving to the pinion gear 50 from the initial location X1 without further expanding the coil spring 30.

Accordingly, before the pinion gear 50 undergoes the reactive force from the ring gear 1, the pinion-side flange 32*a* absorbs the pressure exerted by the coil spring 30 to keep the interval between the ends of the coil spring 30 and the pinion gear 50 greater than or equal to the distance d1. The distance d1 is a distance required for the buffer rubber 40 to desirably achieve the shock-absorbing operation.

The motor-side flange 32*b* is movable away from the stopper 34 in response to contraction of the coil spring 30. This enables the pinion-side flange 32*a* to be moved toward the motor 11. The coil spring 30 is, thus, compressed in response to the reactive force exerted by the ring gear 1 on the pinion gear 50.

The stopper 34 is usually urged by the coil spring 30 against the motor-side flange 32*b*. The amount or distance by which the coil spring 30 is compressed may be determined by selecting the distance d2 between the pinion-side flange 32*a* and the motor-side flange 32*b*, that is, the length of the peripheral side wall 32*c*. The initial elastic force produced by the coil spring 30 is, as described above, set greater than that produced by the buffer rubber 40, so that the stopper 34 is pressed against the motor-side flange 32*b* regardless of the elastic force exerted by the buffer rubber 40 on the cover 31 when the cover 31 is placed in contact with the buffer rubber 40. The amount by which the coil spring 30 is compressed may, therefore, be determined by selecting the length of the peripheral side wall 32*c*.

The cover 31 is designed to have the following structure in order to facilitate the ease with which the coil spring 30 and the stopper 34 are arranged within the cover 31. The cover 31, as clearly illustrated in FIG. 3, has formed in each of circumferences of the holes 33*a* and 33*b* two cutouts or slits 36 for use in mounting the coil spring 30 and the stopper 34 in the cover 31. The slits 36 extend from each of the holes 33*a* and 33*b* in the radial direction of the cover 31 to the outer circumference of a corresponding one of the pinion-side flange 32*a* and the motor-side flange 32*b* (i.e., the peripheral side wall 32*c*) in the shape of rectangle. The slits 36 of each of the pinion-side flange 32*a* and the motor-side flange 32*b* are diametrically opposed to each other with respect to the longitudinal center line of the cover 31, in other words, arranged at an interval of 180° away from each other in the circumferential direction of the cover 31. Each of the slits 36 has a width in the circumferential direction of the cover 31 which is greater than the thickness of the stopper 34.

How to place the pinion-side flange 32*a* and the motor-side flange 32*b* inside the cover 31 through the slits 36 will be described below.

The installation of the stopper 34 in the cover 31 will first be discussed. Before the cover 31 is fitted on the inner tube 25, the plane of the pinion-side flange 32*a* or the motor-side flange 32*b* is first placed perpendicular to that of the stopper 34. The stopper 34 is then inserted into the cover 31 through the slits 36. Afterwards, the stopper 34 is turned within the cover 31 to orient the plane of the stopper 34 parallel to those of the pinion-side flange 32*a* and the motor-side flange 32*b*, in other words, align the center axis of the stopper 34 with that of the cover 31.

Next, the installation of the coil spring 30 in the cover 31 will be discussed. The coil spring 30 is, as described above, made of a helical spring. Before the cover 31 is fitted on the inner tube 25, either of ends of the coil spring 30 is inserted into the slit 36, after which the coil spring 30 is turned in the circumferential direction thereof until the coil spring 30 is fully disposed inside the cover 31. The installation of the coil spring 30 is preferably achieved after the stopper 34 is placed in the cover 31.

The distance d2 between the pinion-side flange 32*a* and the motor-side flange 32*b* in the cover 31 is smaller than the natural length of the coil spring 30 when uncompressed. When the coil spring 30 and the stopper 34 are installed in the cover 31 before the cover 31 is mounted on the inner tube 25, the stopper 34 will, therefore, be urged by the elastic force produced by the coil spring 30 against the motor-side flange 32*b*. This eliminates or minimizes misalignment between the coil spring 30 and the stopper 34 when the cover 31 is fitted on the inner tube 25 with the coil spring 30 and the stopper 34 arranged in the cover 31. This also facilitates the installation of the pinion gear 50 on the inner tube 25 after the cover 31 is fitted on the inner tube 25.

The elastic force the buffer rubber 40 is capable of producing is, as described above, set smaller than that the coil spring 30 is capable of producing. This results in a risk that when an excessive degree of force, as produced when the pinion gear 50 has been shifted to the ring gear 1 and then undergone the reactive force from the ring gear 1, is added to the buffer rubber 40, the buffer rubber 40 is greatly deformed to the degree to which the buffer rubber 40 is not returned to its original shape. In order to alleviate such a problem, the starter 10 is designed to have the following structure to absorb excessive pressure acting on the buffer rubber 40 between the pinion gear 50 and the coil spring 30.

The end of the pinion gear 50 closer to the motor 11 has an outer diameter greater than that of the buffer rubber 40 (i.e., the housing groove 41). The pinion gear 50 has the annular stopper surface 50*a* formed between the teeth 50*b* (i.e., tooth bottoms) and the housing groove 41 of the pinion gear 50. The outer diameter of the buffer rubber 40 (i.e., the outer diameter of the housing groove 41) is set smaller than that of the cover 31. In other words, the outer diameter of the buffer rubber 40 (i.e., the outer diameter of the housing groove 41) is set smaller than that of the pinion-side flange 32*a* of the cover 31. Therefore, when the buffer rubber 40 is placed in contact with the pinion-side flange 32*a*, the pinion-side flange 32*a* has the angular stopper surface 31*a* defined outside the buffer rubber 40 in the radial direction thereof.

The case where an excessive force is applied to the buffer rubber 40 from the pinion gear 50 or the cover 31 will be discussed below.

The application of the force will cause the buffer rubber 40 to be contracted, thereby resulting in physical contact of the stopper surface 50*a* of the pinion gear 50 with the stopper surface 31*a* of the cover 31 in the axial direction of the inner tube 25. This prevents the buffer rubber 40 from being subjected to more force after the stopper surface 50*a* contacts the stopper surface 31*a*. In other words, the stopper surface 50*a* and the stopper surface 31*a* serve to absorb an excess of the force exerted by the pinion gear 50 or the cover 31 on the buffer rubber 40, thereby preventing the buffer rubber 40 from being deformed beyond its elastic limit, in other words, to an undesirable extent that the buffer rubber 40 does not return to its original shape. The stopper surface 50*a* of the pinion gear 50 and the stopper surface 31*a* of the pinion-side flange 32*a*, thus, function as a pressure absorber or deformation stopper between the pinion gear 50 and the pinion-side flange 32*a* to stop the buffer rubber 40 from being excessively deformed by the reactive force from the ring gear 1. The depth of the housing groove 41 and the thickness of the buffer rubber 40 are selected to enable the buffer rubber 40 to return to its original shape when the buffer rubber 40 is compressed fully within the housing groove 41.

Figure 4A:
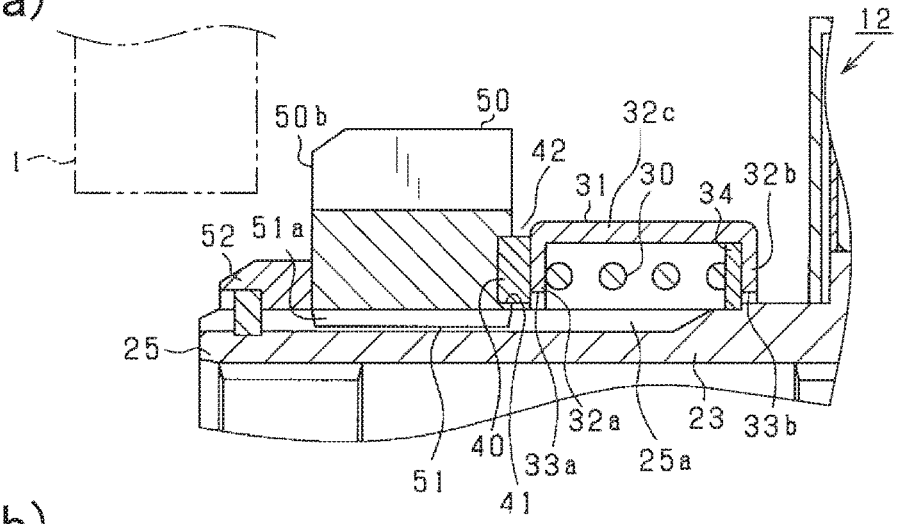
FIGS. 4(*a*), 4(*b*), and 4(*c*) are partially sectional views which demonstrate a shock-absorbing operation when a pinion gear collides with a ring gear.
Figure 4B:
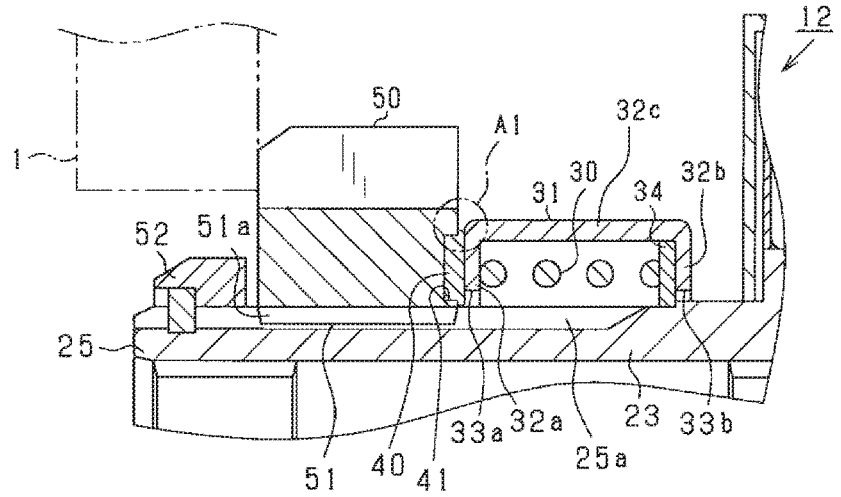
Figure 4C:
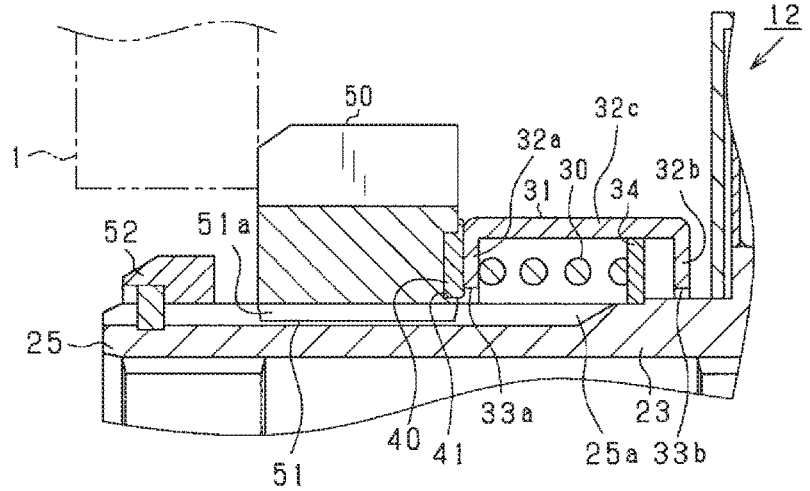

Before the pinion gear 50 is subjected to the reactive force from the ring gear 1, the air gap 42 is, as clearly illustrated in FIG. 4(*a*), formed in the shape of a void between the stopper surface 50*a* of the pinion gear 50 and the stopper surface 31*a* of the cover 31 outside the buffer rubber 40 in the radial direction of the buffer rubber 40. When deformed, the buffer rubber 40 partially enters the air gap 42. In other words, the air gap 42 permits the buffer rubber to expand outward in the radial direction thereof when the buffer rubber 40 is pressed or compressed between the pinion gear 50 and the cover 31. The diameter of the through-hole 33*a* of the pinion-side flange 32*a* is greater than the inner diameter of the buffer rubber 40 (i.e., the inner diameter of the housing groove 41), thereby permitting the buffer rubber 40 to partially enter the through-hole 33*a* when the buffer rubber 40 is pressed or compressed between the pinion gear 50 and the cover 31.

The operation of the pinion carrier 12 upon collision of the pinion gear 50 with the ring gear 1 will be described below.

In an initial state, as illustrated in FIG. 4(*a*), where the pinion carrier 12 is advanced toward the ring gear 1, the stopper 34 is pressed by the initial elastic force produced by the coil spring 30 against the motor-side flange 32*b* of the cover 31. The pinion-side flange 32*a* is at the initial location X1. The motor-side flange 32*b* is at the initial location X2. The pinion-side flange 32*a* and the motor-side flange 32*b* are located at the constant interval d2 away from each other. The pinion-side flange 32*a* will, therefore, not be moved from the initial location X1 to the pinion gear 50. The pinion gear 50 is held by the stopper 42 from advancing, so that the interval between the pinion gear 50 and the cover 31 is kept at the distance d1.

Afterward, when the starter switch is closed, so that it is turned on, it will cause the pinion shifter 13*a* to move the pinion gear 50 together with the pinion carrier 12 to the ring gear 1 (i.e., the left in FIG. 4(*a*)). In FIGS. 4(*a*) to 4(*c*), the location of the ring gear 1 is indicated by a broken line.

When the pinion gear 50, as illustrated in FIG. 4(*b*), collides with the ring gear 1, it will produce impact force which is exerted on the pinion gear 50 in the form of reactive force. The pinion gear 50 is, thus, shifted toward the motor 11 (i.e., the right in FIG. 4(*b*)) in the axial direction of the inner tube 25. Such movement of the pinion gear 50 relative to the inner tube 25 will result in a decrease in interval between the pinion gear 50 and the pinion-side flange 32*a* and also cause the buffer rubber 40 to be contracted, thereby absorbing the reactive force exerted on the pinion gear 50 to reduce the impact noise arising from the collision between the pinion gear 50 and the ring gear 1. This also reduces impact noise resulting from collision of the pinion gear 50 with the cover 31.

When a degree of force which is greater the initial elastic force produced by the coil spring 30 is applied to the cover 31 with which the buffer rubber 40 contacts to urge the cover 31 to the motor 11, it will cause the motor-side flange 32*b* to be shifted away from the stopper 34. The buffer rubber 40, therefore, works to absorb the reactive force and moves toward the motor 11 relative to the inner tube 25 while pressing the cover 31.

The air gap 42 is, as described above, formed outside the buffer rubber 40 in the radial direction thereof between the end of the pinion gear 50 closer to the motor 11 and the pinion-side flange 32*a* of the cover 31. This permits the buffer rubber 40 to be deformed in the radial direction thereof as long as in the axial direction thereof (see A1 in FIG. 4(*b*)). The though-hole 33*a* is shaped to have a diameter greater than the inner diameter of the buffer rubber 40, thereby permitting the buffer rubber 40 to be compressed so that it enters the through-hole 33*a*.

When the buffer rubber 40 and the cover 31 are, as illustrated in FIG. 4(*c*), moved closer to the motor 11 on the inner tube 25, the coil spring 30 is compressed to fully absorb the reactive force exerted on the pinion gear 50. As apparent from the above discussion, upon application of the reactive force to the pinion gear 50, the coil spring 30 and the buffer rubber 40 work to absorb it to eliminate the impact noise arising from the collision of the pinion gear 50 with the ring gear 1. The elastic force generated by compression of the coil spring 30 is transmitted to the pinion gear 50 through the buffer rubber 40, thereby moving the pinion gear 50 toward to the top end of the inner tube 25, in other words, pressing the pinion gear 50 to achieve mesh with the ring gear 1.

When the buffer rubber 40 is compressed, so that the stopper surface 50*a* of the pinion gear 50 contacts the stopper surface 31*a* of the cover 31, it stops the buffer rubber 40 from being further compressed in the axial direction thereof. Accordingly, when the pinion gear 50 is subjected to the reactive force from the ring gear 1, there is no risk that the buffer rubber 40 is subjected to an excessive force so that it is deformed to the extent that the buffer rubber 40 does not return to its original shape.

The length of the coil spring 30 and the thickness of the buffer rubber 40 are, as described above, set shorter than the natural length and natural thickness thereof before the pinion gear 50 collides with the ring gear 1, so that the coil spring 30 and the buffer rubber 40 continue to produce elastic force in the axial direction thereof, thereby facilitating dampening of the impact noise.

The above described structure of the starter 10 offers the following beneficial advantages.

The starter 10 of this embodiment is designed to have the coil spring 30 and the buffer rubber 40 arranged between the pinion gear 50 and the motor 11. When the pinion gear 50 is subjected to the reactive force from the ring gear 1, the coil spring 30 and the buffer rubber 40 work to absorb the reactive force. The coil spring 30 is compressed in response to the reactive force, thereby permitting the pinion gear 50 to slide on the inner tube 25 to the motor. The starter 10 is, as apparent from the above, equipped with the coil spring 30 and the buffer rubber 40 as elastic members. The coil spring 30 permits the pinion gear 50 to move relative to the inner tube 25. The buffer rubber 40 is disposed between the coil spring 30 and the pinion gear 50. Accordingly, when the pinion gear 50 is shifted to the motor 11 relative to the inner tube 25 in response to the reactive force from the ring gear 1, the buffer rubber 40 is compressed to absorb the reactive force to minimize the impact noise between the ring gear 1 and the pinion gear 50. When the coil spring 30 is being compressed to permit the pinion gear 50 to be moved relative to the inner tube 25, the buffer rubber 40 also functions as an absorber to reduce noise resulting from collision of the pinion gear 50 with the cover 31 located closer to the coil spring 30 than the buffer rubber 40 is.

The cover 31, as described above, retains the coil spring 30 therein while exerting a given initial load to the coil spring 30 is equipped with the pinion-side flange 32*a* placed in contact with the buffer rubber 40 in the axial direction of the inner tube 24. The pinion-side flange 32*a* is held from moving to the pinion gear 50 in response to expansion of the coil spring 30, but permitted to move to the motor 11 in response to compression of the coil spring 30. Specifically, the pinion-side flange 32*a* is stopped from moving to the pinion gear 50 in response to the expansion of the coil spring 30, thereby reducing an undesirable amount of compression of the buffer rubber 40 between the pinion gear 50 and the coil spring 30 which arises from application of elastic force from the coil spring 30.

Consequently, an allowable amount by which the buffer rubber 40 is permitted to be compressed at an initial stage where the reactive force is exerted by the ring gear 1 on the pinion gear 50 is ensured, thereby assuring the stability in absorbing the impact arising from the collision of the pinion gear 50 with the ring gear 1 using the buffer rubber 40. The pinion-side flange 32*a* is, as described above, permitted to move to the motor 11 following the compression of the coil spring 30, thereby absorbing the reactive force from the ring gear 1 and permitting the pinion gear 50 to be retracted. The starter 10 of this embodiment is, therefore, capable of minimizing the mechanical noise appearing when the pinion gear 50 is advanced to the ring gear 1.

The stopper 34 is secured to the inner tube 25 and thus works to stop the motor-side flange 32*b* from moving from the initial location X2 where the stopper 34 is subjected to no reactive force from the ring gear 1 toward the pinion gear 50.

The motor-side flange 32*b* is located on the opposite side of the stopper 45 to the coil spring 30. In other words, the stopper 34 and the motor-side flange 32 are arranged in the axial direction of the inner tube 25. This layout of the stopper 34 protruding from the outer periphery of the inner tube 25 and the motor-side flange 32*b* of the cover 31 facilitates holding of the pinion-side flange 32*a* from moving to the pinion gear 50.

When the pinion gear 50 is shifted to the ring gear 1, so that the coil spring 30 is compressed by the reactive force from the ring gear 1, it will cause the motor-side flange 32*b* to be moved away from the stopper 34 to the motor 11. This also cause the pinion-side flange 32*a* of the cover 31 to be moved to the motor 11, thereby absorbing the reactive force from the ring gear 1.

When the buffer rubber 40 is deformed by the reactive force from the ring gear 1, it partially enters the air gap 42 between the pinion gear 50 and the pinion-side flange 32*a*. This avoids a direct contact between the pinion gear 50 and the pinion-side flange 32*a*, thereby avoiding mechanical noise arising from the direct contact between the pinion gear 50 and the pinion-side flange 32*a*.

The buffer rubber 40 is shaped to be smaller in size than the coil spring 30 and mounted in the housing groove 41 of the pinion gear 50, while the coil spring 30 which works to absorb the reactive force transmitted from the pinion gear 50 is arranged at an interval away from the pinion gear 50. This enables the housing groove 41 formed in the pinion gear 50 to be reduced in size, which permits the pinion gear 50 to be reduced in size and weight thereof. The magnitude of impact noise generated between the ring gear 1 and the pinion gear 50 usually depends upon the weight of the pinion gear 50. The level of the impact noise may, therefore, be decreased by reducing the weight of the pinion gear 50.

The initial elastic force produced by the coil spring 30 and the buffer rubber 40 create no air gap between the pinion gear 50 and the buffer rubber 40 and between the buffer rubber 40 and the coil spring 30. This eliminates a risk that the impact noise occurs between the pinion gear 50 and the buffer rubber 40 or between the buffer rubber 40 and the coil spring 30.

The pinion-side flange 32*a* is, as described above, held from moving from the initial location X1 to the pinion gear 50 in the axial direction of the inner tube 25, thereby eliminating a probability that the coil spring 30 and the cover 31 are misaligned with each other after the coil spring 3 is positioned in the cover 31. In other words, the ease with which the pinion gear 50 is mounted on the inner tube 25 is facilitated after the cover 31 is fit on the inner tube 25. The pinion-side flange 32*a* is placed at the initial location X1, thereby facilitating the ease with which the pinion gear 50 is correctly positioned at the distance d1 away from the coil spring 30 (i.e., the end of the cover 31), that is, the stopper 52 is correctly mounted on the inner tube 25 before the reactive force is exerted on the pinion gear 50 from the ring gear 1.

The coil spring 30 is arranged between the pinion-side flange 32*a* and the motor-side flange 32*b* of the cover 31. The distance d2 between the pinion-side flange 32*a* and the motor-side flange 32*b* of the cover 31 is kept constant. An amount by which the coil spring 30 is compressed, in other words, the degree of initial load required to be exerted on the coil spring 30 may, therefore, be determined by selecting the interval between the pinion-side flange 32*a* and the motor-side flange 32*b*. The coil spring 30 is disposed in the cover 31, thereby facilitating the ease with which the coil spring 30 is mounted on the inner tube 25 along with the cover 31.

The buffer rubber 40 is fit in the housing groove 41 formed in the pinion gear 50, thereby preventing the buffer rubber 40 from being deformed or expanded to the extent that the buffer rubber 40 does not return to its original shape when the inner tube 25 is being rotated. The mounting of the buffer rubber 40 in the housing groove 41 enables the buffer rubber 40 to be attached to the inner tube 25 together with the pinion gear 50.

When the pinion gear 50 is subjected to the reactive force from the ring gear 1, the stopper surface 50*a* of the pinion gear 50 contacts or abuts the stopper surface 31*a* of the cover 31 to avoid application of an excessive pressure to the buffer rubber 40. This eliminates a risk that the buffer rubber 40 is deformed by the reactive force to the extent that it does not return to its original shape.

Modifications

The starter 10 is not limited to the above structure, but may be modified as discussed below. In the following discussion, the same reference numbers as in the above embodiment refer to the same or similar parts, and explanation thereof in detail will be omitted here.

The inner tube 25 may have a stopper in the shape of a protrusion which is formed at least on a portion of the outer circumference of the inner tube 25 and located closer to the motor 11 than the coil spring 30 is. In this case, an interval between side walls (i.e., upright surfaces) of the stopper opposed to each other in the circumferential direction of the inner tube 25 may be used as an air gap which enables the motor-side flange 32*b* to be arranged closer to the motor 11 than the stopper is on the inner tube 25 when the cover 31 is mounted on the inner tube 25.

Figure 5A:
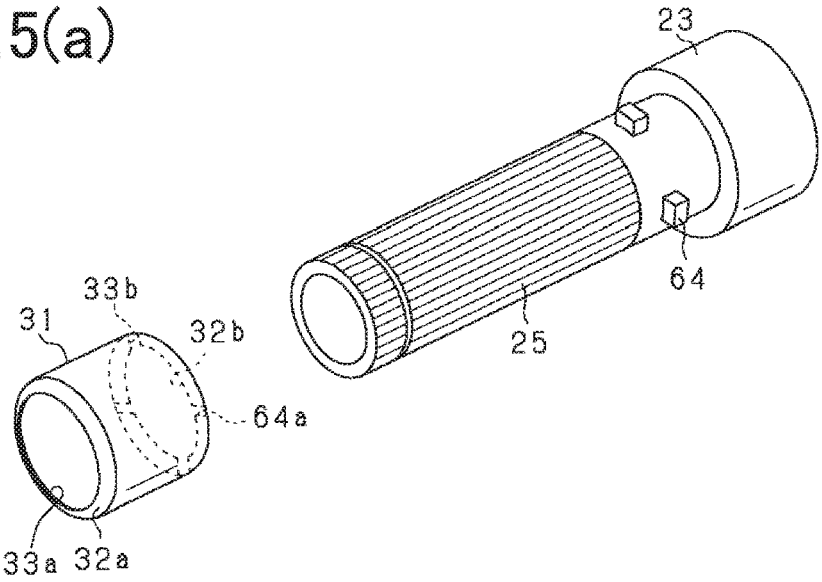
FIG. 5(*a*) is an exploded perspective view which illustrates an inner tube and a cover mounted on the inner tube in a modification of the starter of FIG. 1.
Figure 5B:
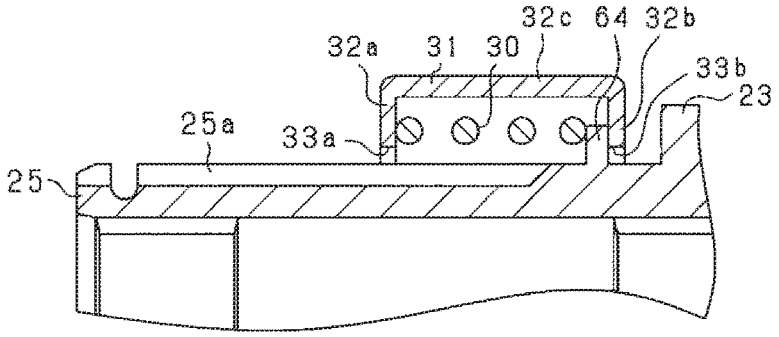

The above stopper will be described in detail with reference to FIGS. 5(*a*) and 5(*b*). In the illustrated example, the inner tube 25 has four stoppers 64 which are each formed in the shape of a protrusion on the outer periphery thereof and located at an interval of 90° away from each other in the circumferential direction of the inner tube 25. Each of the stoppers 64 is made of a rectangular or square pole, but may be of a circular cylindrical shape. The motor-side flange 32*b* of the cover 31 has formed therein cutouts or slits 64*a* through which the stoppers 64 are movable in the axial direction of the inner tube 25. Specifically, the motor-side flange 32*b* of the cover 31 has the slits 64*a* extending radially outward from an outer edge of the through-hole 33*b* in order to enable the motor-side flange 32*b* to move toward the motor 11 over the stoppers 64 when the cover 31 is mounted on the inner tube 25 in an assembling process of the starter 10. In other words, the installation of the cover 31 on the inner tube 25 may be achieved, as can be seen in FIG. 5(*b*), by passing the motor-side flange 32*b* through air gaps each of which is created between adjacent two of the stoppers 64 in the circumferential direction of the inner tube 25 toward the motor 11. The inner tube 25 (i.e., the rotation shaft of the motor 11) may have at least one stopper 64 in the shape of a protrusion formed on at least a portion of the outer circumference thereof.

Specifically, the installation of the cover 31 on the inner tube 25 is achieved by fitting the cover 31 on the inner tube 25, shifting the motor-side flange 32*b* to the motor 11 over the stoppers 64, and then rotating the cover 31 to a given angular location. This, as illustrated in FIG. 5(*b*), arranges the motor-side flange 32*b* to be closer to the motor 11 than the stoppers 64 are on the inner tube 25. The motor-side flange 32*b* is, therefore, subjected to the elastic force from the coil spring 30 through the stoppers 64. The use of the stoppers 64 eliminates a process of press-fitting the stopper 34 on the inner tube 25 along with the cover 31.

The inner tube 25 may alternatively have an axially elongated protrusion as a stopper which is formed at least on a portion of the outer circumference of the inner tube 25 and located closer to the motor 11 than the coil spring 30 is. The motor-side flange 32*b* is shaped to be movable on the inner tube 25 closer to the motor 11 than the protrusion is. The motor-side flange 32*b* is subjected to elastic force produced by the coil spring 30 through the protrusion after the motor-side flange 32*b* is arranged in place.

Figure 6:
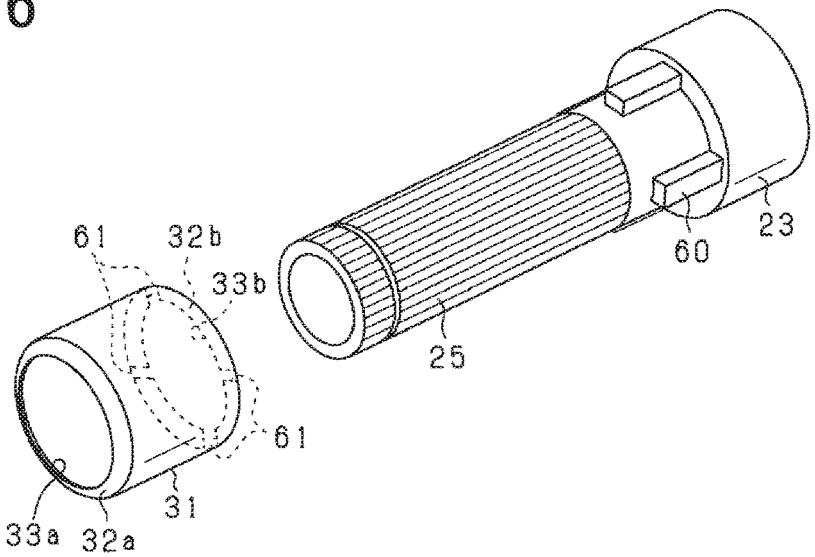
FIG. 6 is an exploded perspective view which illustrates an inner tube and a cover mounted on the inner tube in the second modification of the starter of FIG. 1.

The above stopper will be described in detail with reference to FIG. 6. In the illustrated example, the inner tube 25 has four stoppers 60 which are each formed in the shape of a protrusion on the outer periphery thereof and located at an interval of 90° away from each other in the circumferential direction of the inner tube 25. Each of the stoppers 60 has a length extending in the axial direction of the inner tube 25. The motor-side flange 32*b* has formed therein cutouts or slits 61 substantially contoured to conform with the outline of the stoppers 60. Specifically, the motor-side flange 32*b* has the slits 61 which extend radially outward from the outer edge of the through-hole 33*b* and are arranged at an interval of 90° away from each other in the circumferential direction of the motor-side flange 32*b*. Each of the slits 61 has a size large enough to pass a corresponding one of the stoppers 60 therethrough. This permits the motor-side flange 32*b* to be moved on the inner tube 25 closer to the motor 11 than the front ends (i.e., left ends in FIG. 6) of the stoppers 60 are. After the motor-side flange 32*b* is placed closer to the motor 11 than the stoppers 60 are, the stoppers 60 are, therefore, subjected at the front ends thereof to the elastic force produced by the coil spring 30. The coil spring 30 is placed in contact with portions of the motor-side flange 32*b* other than the slits 61, so that it is retained by the cover 31. The stoppers 60 work to hold the pinion-side flange 32*a* from moving to the pinion gear 50 in response to expansion of the coil spring 30. The inner tube 25 may alternatively designed to at least one stopper 60.

In operation, when the pinion gear 50 is advanced, so that the coil spring 30 is compressed by the reactive force from the ring gear 1, it causes the motor-side flange 32*b* to be moved closer to the motor 11 than the front ends of the stoppers 60 are on the inner tube 25. The front ends of the stoppers 60 are then subjected to the elastic force produced by the coil spring 30, thereby absorbing the reactive force from the ring gear 1.

Figure 7:
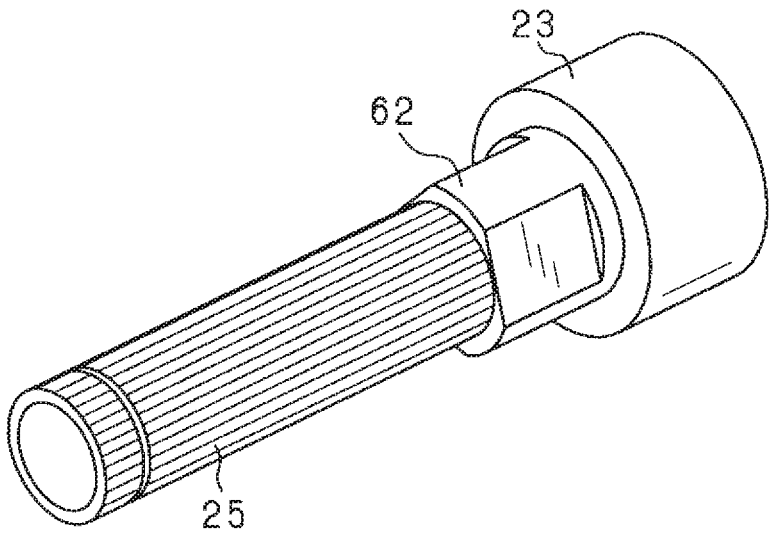
FIG. 7 is a perspective view which illustrates an inner tube and a cover mounted on the inner tube in the third modification of the starter of FIG. 1.

The starter 10 may alternatively be designed to have the inner tube 25 which is, as illustrated in FIG. 7, equipped with the flange 62. The inner tube 25, as already described, has the straight splines 25*a* formed on the outer periphery thereof, and also has the flange 62 located closer to the motor 11 than the straight splines 25*a* are. The flange 62 functions as a stopper similar to the stopper 34. The motor-side flange 32*b* of the cover 31, like in the first embodiment, has formed therein the through-hole 33*b* couture to conform with the outline of the flange 62 for enabling the flange 62 to pass through the through-hole 33*b* in the axial direction of the inner tube 25. The motor-side flange 32*b* is, thus, movable closer to the motor 11 over the flange 62 on the periphery of the inner tube 25. When the motor-side flange 32*b* has been moved in response to the reactive force from the ring gear 1 to the motor 11 over the flange 62, the end of the flange 62 is subjected to the elastic force produced by the coil spring 30 to have substantially the same effects as in FIG. 6. The flange 62 may be formed on at least a portion of the circumference of the inner tube 25.

Figure 8:
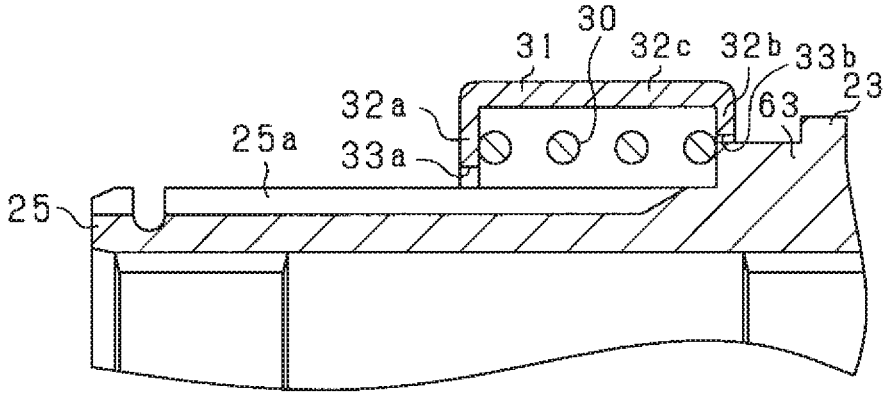
FIG. 8 is a partially sectional view which illustrates an inner tube and a cover mounted on the inner tube in the fourth modification of the starter of FIG. 1.

The starter 10 may alternatively be designed to have the inner tube 25 which is, as illustrated in FIG. 8, equipped with the flange 63. The inner tube 25, as already described, has the straight splines 25*a* formed on the outer periphery thereof, and also has the flange 63 located closer to the motor 11 than the straight splines 25*a*. The flange 63 functions as a stopper similar to the stopper 34. The motor-side flange 32*b* of the cover 31, like in the first embodiment, has formed therein the through-hole 33*b* whose diameter is greater than that of the flange 63. The diameter of the through-hole 33*b* is set smaller than the outer diameter of the coil spring 30. The motor-side flange 32*b* is, thus, movable on the inner tube 25 to the motor 11 than the front end of the flange 62 facing the pinion gear 50. When the motor-side flange 32*b* has been moved closer to the motor 11 than the front end of the flange 63 is, as illustrated in FIG. 8, the front end of the flange 63 is subjected to the elastic force produced by the coil spring 30 to offer substantially the same effects as in FIG. 6. The flange 63 may be formed on at least a portion of the circumference of the inner tube 25.

Figure 9A:
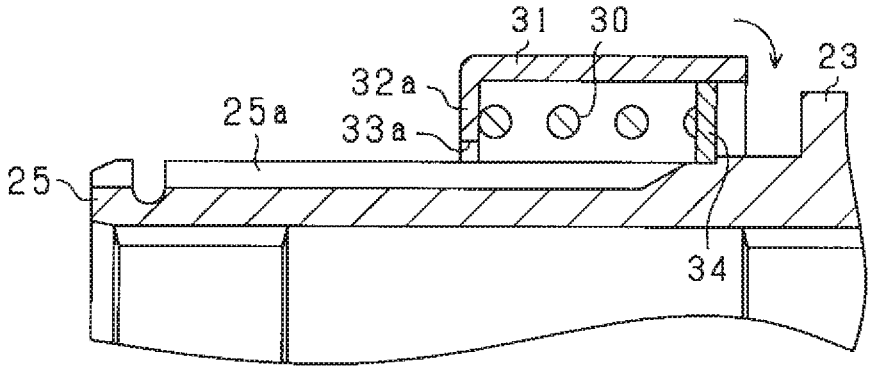
FIGS. 9(*a*) and 9(*b*) are partially sectional views which illustrate modifications of an inner tube mounted in the starter of FIG. 1.
Figure 9B:
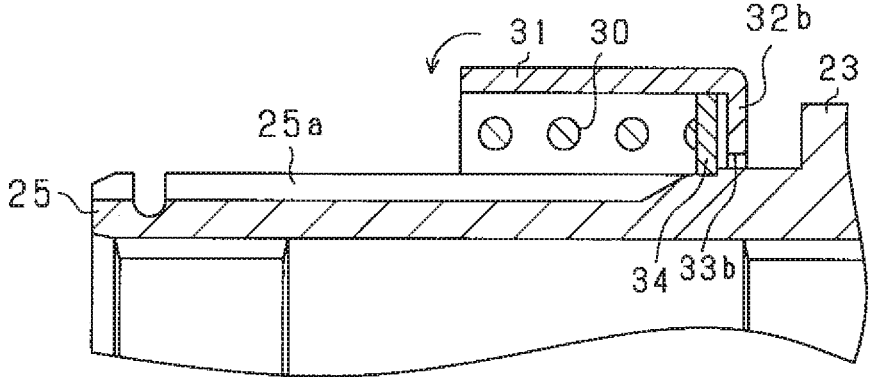

The cover 31 may be, as illustrated in FIG. 9(*a*) or 9(*b*), made of a hollow cylinder with an open end which faces, as illustrated in FIG. 9(*a*) the motor 11 or alternatively faces, as illustrated in FIG. 9(*b*), the ring gear 1 (i.e., the pinion gear 50). In the example in FIG. 9(*a*), an assembly of the coil spring 30 and the cover 31 (i.e., the hollow cylinder with the open end facing the motor 11) is first mounted at a given location on the inner tube 25. Subsequently, the end of the cover 31 which faces the motor 11 is bent at substantially right angles inwardly in the radial direction of the inner tube 25 to complete the cover 11. Similarly, in the example in FIG. 9(*b*), an assembly of the coil spring 30 and the cover 31 (i.e., the hollow cylinder with the open end facing the pinion gear 50) is first mounted at a given location on the inner tube 25. Subsequently, the end of the cover 31 which faces the pinion gear 50 is bent at substantially right angles inwardly in the radial direction of the inner tube 25 to complete the cover 11.

Figure 10:
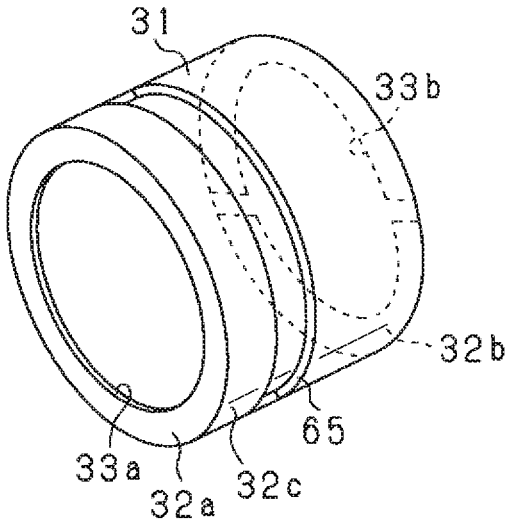
FIG. 10 is a perspective view which illustrates a modification of a cover mounted in the starter of FIG. 1.

The cover 31 may alternatively be, as illustrated in FIG. 10, shaped to have an arc-shaped cutout or slit 65 formed in the outer periphery (i.e., the peripheral side wall 32*c*) thereof for enabling the stopper 34 and the coil spring 30 to be inserted into the cover 31 in the assembling process of the cover 31. The slit 65 is formed in a middle portion of the length of the cover 31 in the axial direction of the inner tube 25 and occupies substantially 180° of the circumference of the cover 31.

Figure 11A:
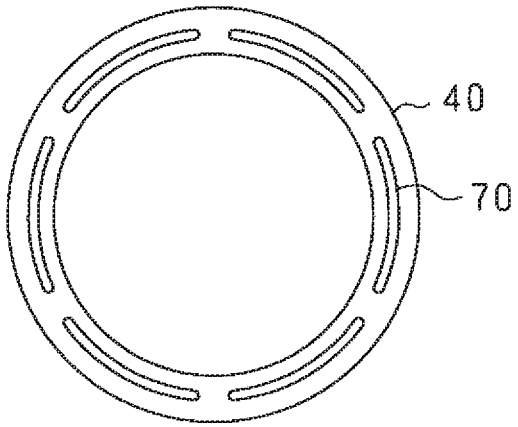
FIGS. 11(*a*) and 11(*b*) are views which illustrate modifications of a buffer rubber mounted in the starter of FIG. 1.
Figure 11B:
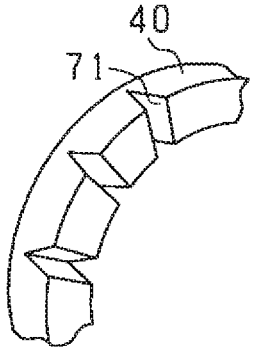

The buffer rubber 40 may alternatively be shaped to have a structure illustrated in FIG. 11(*a*) or 11(*b*). In the example of FIG. 11(*a*), the buffer rubber 40 has a plurality of protrusions 70 in the shape of a ridge which are formed on the end surface thereof facing the motor 11. In the example of FIG. 11(*b*), the buffer rubber 40 has a plurality of cutouts or notches 71 formed in the end surfaces. The notches 71 are arranged at a given angular interval away from each other in the circumferential direction of the buffer rubber 40. The degree of elastic force produced by the buffer rubber 40 (i.e., the elastic constant of the buffer rubber 40) may be determined by selecting the number or size of the protrusions 70 or the notches 71.

Figure 12:
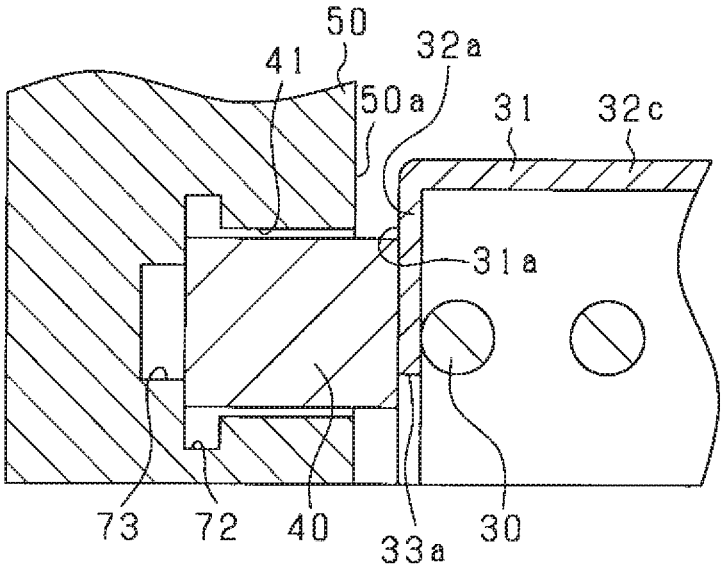
FIG. 12 is a partially sectional view which illustrate a modification of a housing groove for a buffer rubber mounted in the starter of FIG. 1.

The housing groove 41 may alternatively be formed to have a shape illustrated in FIG. 12. Specifically, the housing groove 41 may have formed in the inner wall thereof a void for permitting the buffer rubber 40 to be deformed upon application of a physical impact thereto in the axial direction of the buffer rubber 40 which arises from collision of the pinion gear 50 with the ring gear 1. For instance, the housing groove 41 may have, as illustrated in FIG. 12, the recess 72 formed in the shape of a void in the inner circumferential wall thereof. The housing groove 41 may alternatively or additionally have the recess 73 formed in the shape of a void in the bottom wall thereof. The recess 72 or 73 may be shaped in the form of a circular groove.

The elastic constant and/or length of the coil spring 30 in the axial direction of the inner tube 25 may be changed as needed. Similarly, the elastic constant and/or dimension (i.e., thickness) of the buffer rubber 40 in the axial direction of the inner tube 25 may be changed as needed. For instance, the above parameters of the coil spring 30 and the buffer rubber 40 may be selected to produce a degree of elastic force required to fully absorb impact force exerted on the pinion gear 50 using a combination of the coil spring 30 and the buffer rubber 40.

The stopper 34 may not be firmly secured to the inner tube 25 as long as the pinion gear 50 and the cover 31 are arranged at an interval away from each other which is required to achieve a desired impact-absorbing operation of the buffer rubber 40. In other words, the cover 31 may be slightly movable as long as it holds the coil spring 30 from expanding in order not to excessively deform the buffer rubber 40 before subjected to the reactive force from the ring gear 1.

The pinion gear 50 may have a stopper located inside the buffer rubber 40 in the radial direction of the inner tube 25. In this case, the pinion-side flange 32*a* of the cover 31 is needed to have a stopper which is contactable with the stopper of the pinion gear 50. For instance, the stopper of the pinion-side flange 32*a* may be formed by selecting the diameter of the through-hole 33*a* to be smaller than the inner diameter of the buffer rubber 40 (i.e., the inner diameter of the housing groove 41).

In the above embodiment, the buffer rubber 40 is partially disposed in the housing groove 41, but may alternatively be fully placed within the housing groove 41 as long as it is elastically contactable with the case 31. For instance, the pinion-side flange 32*a* of the cover 31 may be shaped to have a protrusion contoured to conform with the configuration of the housing groove 41 or alternatively be formed to be insertable into the housing groove 41 so as to make a physical contact with the buffer rubber 40.

The cover 31 may alternatively be designed, instead of the pinion gear 50, to have the housing groove 41 in which the buffer rubber 40 is disposed. This enables the pinion gear 50 to be reduced in size and weight thereof. Both the pinion gear 50 and the cover 31 may alternatively have formed therein housing grooves which are opposed to each other to define a chamber in which the buffer rubber 40 is mounted.

The cover 31 may alternatively be shaped to have a structure other than described above as long as it covers at least a radially outer portion of the coil spring 30. For instance, the cover 31 may be shaped to have the motor-side flange 32*b* which does not contact the coil spring 30. Specifically, the cover 31 may have an opening in the motor-side flange 32*b*.

In the above embodiment, the stopper 34 is placed in contact with the motor-side flange 32*b* to stop the pinion-side flange 32*b* from moving before the pinion gear 50 is subjected to the reactive force from the ring gear 1, but the inner tube 25 may alternatively be formed to have a protrusion which functions as a stopper contactable with the pinion-side flange 32*a* in the axial direction of the inner tube 25 in order to hold the pinion-side flange 32*a* from moving from the initial location X1 to the pinion gear 50. For instance, the protrusion may be formed on the outer periphery of the inner tube 25 at the initial location X1 and have a height or an outer end located outside the through-hole 33*a* in the radial direction of the inner tube 25, so that it contacts the pinion-side flange 32*a*. It is preferable that the inner circumference of the buffer rubber 40 is located outside the outer end of the protrusion so that the buffer rubber 40 does not physically interfere with the protrusion. The formation of such a protrusion enables the motor-side flange 32*b* of the cover 31 to be opened partially or fully and eliminates the need for designing the motor-side flange 32*b* to be contactable with the coil spring 30.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modifications to the shown embodiment which can be embodied without departing from the principle of the invention as set forth in the appended claims.

What is claimed is:

1. A starter comprising:

a motor which has a rotation shaft;

a pinion gear which is movable in an axial direction of the rotation shaft of the motor;

a shifter which works to shift the pinion gear in the axial direction of the rotation shaft toward a front end of the rotation shaft for bringing the pinion gear into engagement with a ring gear of an internal combustion engine to rotate the pinion gear using the motor to start the internal combustion engine;

a first elastic member which is disposed between the pinion gear and the motor and configured to be compressed to permit the pinion gear to move to the motor along the rotation shaft;

a second elastic member which is disposed between the pinion gear and the first elastic member;

a holder which retains therein the first elastic member while being subjected to a given initial load and is movable in the axial direction of the rotation shaft in response to expansion or contraction of the first elastic member, wherein the holder includes a first pressure-exerted member on which an elastic force, as produced by the first elastic member, is exerted by a first end that is one of opposed ends of the first elastic member which is closer to the pinion gear and a second pressure-exerted member on which the elastic force, as produced by the first elastic member, is exerted by a second end that is one of the opposed ends of the first elastic member which is closer to the motor;

a contacting portion which is formed by a portion of the holder and placed in contact with the second elastic member in the axial direction of the rotation shaft, the contacting portion being held from being moved to the pinion gear in response to expansion of the first elastic member, while being permitted to be moved to the motor in response to contraction of the first elastic member; and a stopper which is placed in contact with the second pressure-exerted member and works to stop the second pressure-exerted member from being moved toward the pinion gear from an initial location where the second pressure-exerted member is not being subjected to reactive force from the ring gear, thereby holding the contacting portion from being moved to the pinion gear.

2. A starter as set forth in claim 1, wherein the first elastic member is implemented by a coil spring wound around an outer periphery of the rotation shaft, wherein the stopper is implemented by a protrusion formed on the outer periphery of the rotation shaft, and wherein the second pressure-exerted member is located on an opposite side of the protrusion to the first elastic member.

3. A starter as set forth in claim 1, wherein the second pressure-exerted member is movable away from the stopper in response to contraction of the first elastic member to permit the contacting portion to be moved to the motor.

4. A starter as set forth in claim 1, wherein the stopper is implemented by a protrusion formed on at least a portion of a circumference of the rotation shaft, the protrusion being located closer to the motor than the first elastic member is, wherein the protrusion has side walls which are opposed to each other in a circumferential direction of the rotation shaft to define an air gap which enables the second pressure-exerted member to be arranged closer to the motor than the stopper is on the rotation shaft when the holder is mounted on the rotation shaft, and wherein the second pressure-exerted member is located closer to the motor than the stopper is and subjected to the elastic force, as produced by the first elastic member, through the stopper.

5. A starter as set forth in claim 1, wherein the holder includes a first pressure-exerted member on which an elastic force, as produced by the first elastic member, is exerted by a first end that is one of opposed ends of the first elastic member which is closer to the pinion gear and a second pressure-exerted member on which the elastic force, as produced by the first elastic member, is exerted by a second end that is one of the opposed ends of the first elastic member which is closer to the motor, and wherein the starter further comprises a protrusion which is formed on at least a portion of a circumference of the rotation shaft and located closer to the motor than the first elastic member is, and wherein the second pressure-exerted member is movable closer to the motor than the protrusion on the rotation shaft, when the second pressure-exerted member is placed closer to the motor than the protrusion is, the second pressure-exerted member being subjected to the elastic force, as produced by the first elastic member, through the protrusion.

6. A starter as set forth in claim 1, wherein the second elastic member is implemented by a shock absorber which is deformed between the pinion gear and the contacting portion by reactive force from the ring gear to absorb impact exerted on the pinion gear, and wherein a void which the second elastic member partially enters when deformed is formed between the pinion gear and the contacting portion.

7. A starter as set forth in claim 1, wherein the second elastic member is implemented by a shock absorber which is deformed between the pinion gear and the contacting portion by reactive force from the ring gear to absorb impact exerted on the pinion gear, and wherein the stopper is disposed between the pinion gear and the contacting portion and serves to stop the second elastic member from being deformed to more than a given extent in response to reactive force from the ring gear.

8. A starter as set forth in claim 1, wherein an initial elastic force produced by the second elastic member is set smaller than that produced by the first elastic member.

* * * * *